US011206498B2

(12) United States Patent
Chao et al.

(10) Patent No.: US 11,206,498 B2
(45) Date of Patent: Dec. 21, 2021

(54) HEARING AID AND HEARING AID OUTPUT VOICE ADJUSTMENT METHOD THEREOF

(71) Applicant: Unlimiter MFA Co., Ltd., Eden Island (SC)

(72) Inventors: Kuan-Li Chao, Taipei (TW); Neo Bob Chih-Yung Young, Taipei (TW); Kuo-Ping Yang, Taipei (TW)

(73) Assignee: PIXART IMAGING INC., Hsin-Chu County (TW)

( * ) Notice: Subject to any disclaimer, the term of this patent is extended or adjusted under 35 U.S.C. 154(b) by 311 days.

(21) Appl. No.: 16/286,689

(22) Filed: Feb. 27, 2019

(65) Prior Publication Data

US 2020/0045479 A1 Feb. 6, 2020

(30) Foreign Application Priority Data

Jul. 31, 2018 (TW) ..... 107126530

(51) Int. Cl.
*H04R 25/00* (2006.01)

(52) U.S. Cl.
CPC ..... *H04R 25/505* (2013.01); *H04R 25/604* (2013.01); *H04R 2225/41* (2013.01); *H04R 2225/43* (2013.01)

(58) Field of Classification Search
CPC ..... H04R 25/505; H04R 25/604; H04R 2225/41; H04R 2225/43
USPC ..... 704/233
See application file for complete search history.

(56) References Cited

U.S. PATENT DOCUMENTS 6,577,739 B1 * 6/2003 Hurtig ..... H04R 25/353 381/106
7,062,434 B2 * 6/2006 Zinser, Jr. ..... G10L 19/173 704/233
8,582,792 B2 11/2013 Chao et al.
9,119,007 B2 * 8/2015 Chao ..... H04R 25/353
2002/0118846 A1 * 8/2002 Narusawa ..... G10L 21/0364 381/103
2007/0127748 A1 * 6/2007 Carlile ..... H04R 25/353 381/312
2008/0101589 A1 * 5/2008 Horowitz ..... H04M 1/035 379/388.03
2009/0259277 A1 * 10/2009 Cornejo Cruz ..... A61B 5/38 607/57
2009/0299742 A1 * 12/2009 Toman ..... G10L 21/0208 704/233

(Continued)

FOREIGN PATENT DOCUMENTS

CN 102547543 A 7/2012

*Primary Examiner* — Thuykhanh Le
(74) *Attorney, Agent, or Firm* — Bacon & Thomas, PLLC

(57) ABSTRACT

A hearing aid and a hearing aid output voice adjustment method thereof are disclosed. The hearing aid includes a microphone, a voice output adjustment module, a voice player, and a voice processing module. The microphone is used for receiving an input voice. The voice player is used for outputting an output voice. The voice processing module is used for receiving the input voice and modifying to the output voice, wherein the voice processing module is used for adjusting sound output energies of at least N steps, wherein the sound output energy of the nth step is greater than that of the n−1th step, $2 \leq n \leq N$, $N \geq 3$. When the voice processing module adjusts the sound output energy of the Nth step, the voice output adjustment module also simultaneously reduces at least a portion of frequencies of the input voice.

8 Claims, 2 Drawing Sheets

(56) References Cited

U.S. PATENT DOCUMENTS

2010/0100388 A1* 4/2010 Kehoe ..... G10L 21/0364 704/271
2011/0095896 A1* 4/2011 Lewis ..... G08B 17/00 340/632
2012/0008793 A1* 1/2012 Knox ..... H04R 1/10 381/74
2012/0101819 A1* 4/2012 Heiman ..... H04R 5/04 704/233
2012/0140964 A1* 6/2012 Chao ..... H04R 25/353 381/316
2012/0197641 A1* 8/2012 Akechi ..... G10L 15/08 704/236
2013/0034234 A1* 2/2013 Chen ..... H04R 25/554 381/58
2014/0023219 A1* 1/2014 Chao ..... H04R 25/353 381/320
2014/0270289 A1* 9/2014 Chao ..... H04R 25/353 381/316
2014/0358530 A1* 12/2014 Young ..... G10L 25/90 704/207
2015/0011192 A1* 1/2015 Young ..... H04M 3/42391 455/414.1
2015/0163600 A1* 6/2015 Liaw ..... H04R 25/356 381/320
2015/0281858 A1* 10/2015 Liao ..... H04M 1/72478 455/557
2016/0099008 A1* 4/2016 Barker ..... H04R 25/505 704/233
2017/0084083 A1* 3/2017 Wilson ..... G09G 5/003
2017/0339496 A1* 11/2017 Epstein ..... H04R 25/554
2018/0035216 A1* 2/2018 Van Hasselt ..... A61B 5/6898
2018/0359578 A1* 12/2018 Boley ..... H04R 25/652
2019/0069107 A1* 2/2019 Gandhi ..... H04R 25/305
2020/0171320 A1* 6/2020 Maier ..... A61F 11/00

* cited by examiner

HEARING AID AND HEARING AID OUTPUT VOICE ADJUSTMENT METHOD THEREOF

BACKGROUND OF THE INVENTION

1. Field of the Invention

The present invention relates generally to a hearing aid and a hearing aid output voice adjustment method thereof, and more particularly, to a hearing aid and a hearing aid output voice adjustment method which can adjust frequencies of output voices.

2. Description of the Related Art

It is now a common practice to control the volume of a sound at any time when a user listens to the sound using a device such as a stereo, a walkman, or a smart phone. However, the hearing impaired or the elderly people may not hear certain frequencies. In the prior art, when the volume is increased, the frequencies of the sound do not change accordingly. As a result, it is still difficult for the hearing impaired or the elderly people to hear the sound, so the sound must be kept at a high volume.

Therefore, it is necessary to provide a new hearing aid and a hearing aid output voice adjustment method to address the deficiencies of the prior art techniques.

SUMMARY OF THE INVENTION

In view of the above problems, it is an object of the present invention to provide a hearing aid which can adjust frequencies of output voices.

It is another object of the present invention to provide a hearing aid output voice adjustment method for the hearing aid described above.

In order to achieve the above object, the present invention discloses a hearing aid which includes a microphone, a voice output adjustment module, a voice player, and a voice processing module. The microphone is used for receiving an input voice. The voice player is used for outputting an output voice. The voice processing module is electrically coupled with the microphone, the voice output adjustment module, and the voice player, the voice processing module is used for receiving the input voice and modifying a sound output energy of the input voice to form the output voice, wherein the voice processing module is used for adjusting sound output energies of at least N steps, wherein the sound output energy of the nth step is greater than that of the n−1th step, $2 \le n \le N$, $N \ge 3$. When the voice processing module adjusts the sound output energy of the Nth step, the voice output adjustment module also simultaneously reduces at least a portion of frequencies of the input voice.

The present invention discloses a hearing aid output voice adjustment method for a hearing aid, the method comprising: receiving an input voice; modifying an sound output energy of the input voice, wherein the sound output energy of the nth step is greater than that of the n−1th step, $2 \le n \le N$, $N \ge 3$; simultaneously reducing at least a portion of frequencies of the input voice to form an output voice; and outputting the output voice.

DETAILED DESCRIPTION OF THE PREFERRED EMBODIMENT

In order to make the structure and characteristics as well as the effectiveness of the present invention to be further understood and recognized, the detailed description of the present invention is provided as follows along with embodiments and accompanying figures.

Figure 1:
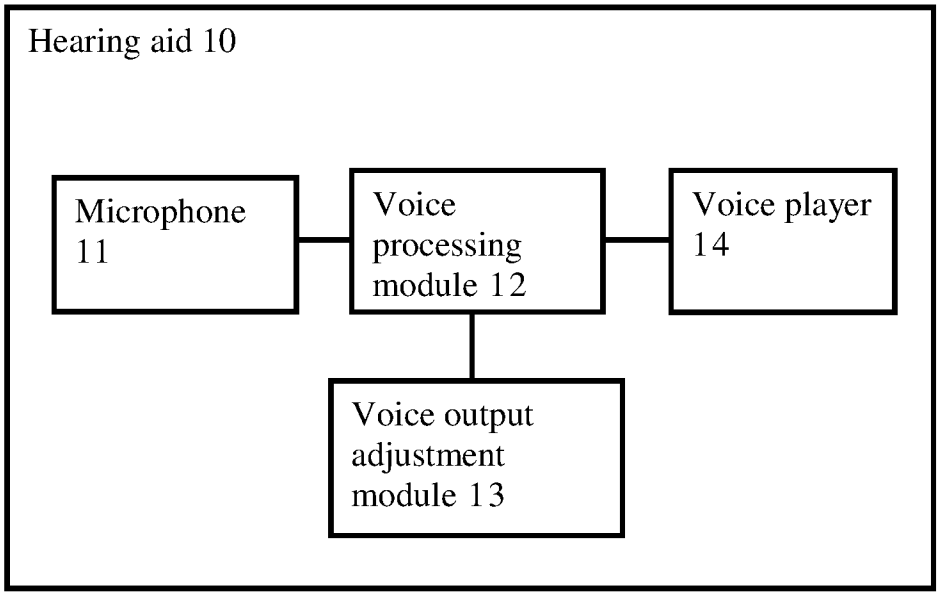
FIG. 1 illustrates a structural view of a hearing aid of the present invention.

Please refer to FIG. 1 for a structural view of a hearing aid of the present invention.

As shown in FIG. 1, a hearing aid 10 of the present invention comprise a microphone 11, a voice processing module 12, a voice output adjustment module 13, and a voice player 14. The microphone 11 is provided for receiving an input voice. The voice player 14 can be a speaker or an earphone for outputting an output voice. The voice processing module 12 can be an amplifier electrically connected with the microphone 11, the voice output adjustment module 13, and the voice player 14. The voice processing module 12 receives the input voice from the microphone 11 and modifies the sound output energy of the input voice to form the output voice. The voice processing module 12 is used for adjusting sound output energies of at least N steps, wherein the sound output energy of the nth step is greater than that of the n−1th step, in an embodiment of the present invention, $2 \le n \le N$, $N \ge 3$ but lower than 10000. However, the upper limit and the lower limit of N can be varied according to different embodiments of the present invention.

When the voice processing module 12 adjusts the sound output energy of the Nth step, the voice output adjustment module 13 also reduces at least a portion of the frequencies of the input voice. When the voice processing module 12 adjusts the sound output energy of the N−1th step, the voice output adjustment module simultaneously reduces at least a portion of frequencies of the input voice, and wherein the extent of reducing at least a portion of frequencies of the input voice when adjusting the sound output energy of the Nth step is greater than the extent of reducing at least a portion of frequencies of the input voice when adjusting the sound output energy of the N−1th step. The voice output adjustment module 13 can reduce at least a portion of frequencies of the input voice for m steps, wherein $n \ge m$. It should be noted that the voice output adjustment module 13 reduces high frequency consonants in the input voice, but the voice output adjustment module 13 does not adjust a vowel frequency in the input voice.

In an embodiment of the present invention, Mandarin Phonetic Symbols (or Bopomofo) are used for explanation. In the case of Mandarin Phonetic Symbols, the vowels are "yi(ㄧ), wu(ㄨ), yu(ㄩ), a(ㄚ), o(ㄛ), e(ㄜ), ê(ㄝ), ai(ㄞ), ei(ㄟ), ao(ㄠ), ou(ㄡ), an(ㄢ), en(ㄣ), ang(ㄤ), eng(ㄥ), er(ㄦ)", and their consonants are "b(ㄅ), p(ㄆ), m(ㄇ), f(ㄈ), d(ㄉ), t(ㄊ), n(ㄋ), l(ㄌ), g(ㄍ), k(ㄎ), h(ㄏ), g(ㄐ), q(ㄑ), x(ㄒ), zhi(ㄓ), chi(ㄔ), shi(ㄕ), zi(ㄗ), ci(ㄘ), si(ㄙ)". Therefore, the voice output adjustment module 13 will first look for the consonants and vowels in the input voice. For example, when the sound of "ㄙㄠ" is pronounced, the voice output adjustment module 13 will find out that the first syllable is "si(ㄙ)" and the second syllable is "ao(ㄠ)", and the voice output adjustment module 13 adjusts the frequency of the first syllable "si(ㄙ)".

Therefore, the relationship between the sound output energy and the frequency of the output voice in an embodiment of the present invention can be as shown in the following table:

| Preset | Gain (dB) | Frequency Transposition (Hz) |
|---|---|---|
| 1 | 5 | None |
| 2 | 10 | None |
| 3 | 15 | 5100 |
| 4 | 20 | 4800 |
| 5 | 25 | 4400 |
| 6 | 30 | 4100 |
| 7 | 35 | 3400 |
| 8 | 40 | 2700 |
| 9 | 45 | 2000 |
| 10 | 50 | 1300 |
| 11 | 55 | 1000 |

When the volume of the first step is to be adjusted to the volume of the second step, the voice processing module 12 adjusts the sound output energy of the input voice input voice from 5 dB to 10 dB; when the volume of the third step is to be adjusted to the volume of the 4th step, the voice processing module 12 adjusts the sound output energy of the input voice from 15 dB to 20 dB. Similarly, the volume of the output voice can be adjusted step by step, and in the present invention, the volume can be adjusted with more than 11 steps. When the volume is being adjusted, the voice output adjustment module 13 also reduces at least a portion of the frequencies of the input voice. For example, when the volume is adjusted to the third step, the voice output adjustment module 13 may transpose at least a portion of the frequency block of the input voice, so that the lowest frequency of the energy distribution block of the input voice is aligned to 5,100 Hz; when the volume is adjusted to the fourth step, the voice output adjustment module 13 aligns the lowest frequency portion of the energy distribution block of the input voice to 4,800 Hz. For the volume of the fourth step, the extent of frequency transposition of the input voice is greater than that of the volume of the third step. In the embodiment of the present invention, when reaching the maximum volume of the eleventh step, the extent of frequency transposition of the input voice is the largest, wherein the lowest frequency of the input voice is aligned to 1,000 Hz. And the voice output adjustment module 13 will adjust the frequencies for less number of steps compared to the number of steps of the volume being adjusted. For example, in the previous table, the voice output adjustment module 13 does not adjust the frequency of the input voice at the first and second steps of volume adjustment. It should be noted that the present invention is not limited to the foregoing table.

It should be noted that, in addition to being configured as a hardware device, a software program, a firmware, or a combination thereof, each of the above-mentioned modules may also be configured by a circuit loop or other suitable types; besides, each module may be configured to be a standalone type or combined with other modules. In addition, the present embodiment is merely illustrative of a preferred embodiment of the present invention, and is not described with all possible combinations of variations in detail. However, those skilled in the art will appreciate that various modules or components described above are not necessarily required. In order to implement the invention, other well-known modules or elements may also be included. Each module or component may be omitted or modified as required. No other modules or components may exist between any two modules.

Figure 2:
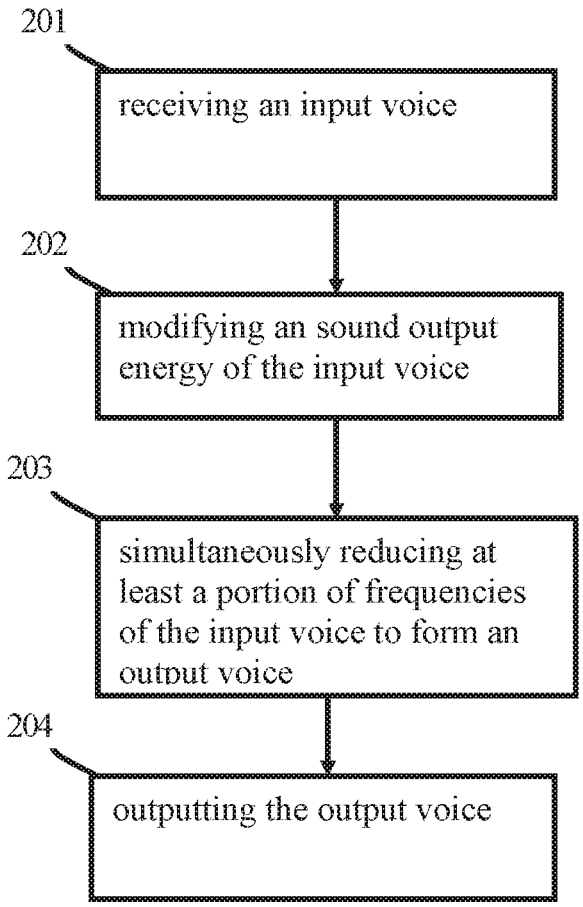
FIG. 2 illustrates a flowchart of a hearing aid output voice adjustment method of the present invention.

Please refer to FIG. 2 for a flowchart of a hearing aid output voice adjustment method of the present invention. It should be noted that, in the following, the above-mentioned hearing aid 10 is used as an example to illustrate the hearing aid output voice adjustment method of the present invention, However, the hearing aid output voice adjustment method is not limited to the use of the hearing aid 10 of the same structure as described above.

First the method proceeds to step 201: receiving an input voice.

First the hearing aid 10 uses the microphone 11 to receive an input voice.

Then the method proceeds to step 202: modifying a sound output energy of the input voice.

Then the voice processing module 12 modifies a sound output energy of the input voice received from the microphone 11. The voice processing module 12 is used for adjusting sound output energies of at least N steps, wherein the sound output energy of the nth step is greater than that of the n−1th step.

Then the method proceeds to step 203: simultaneously reducing at least a portion of frequencies of the input voice to form an output voice.

Then the voice output adjustment module 13 simultaneously reduces at least a portion of frequencies of the input voice. When the voice processing module 12 adjusts the sound output energy of the N−1th step, the voice output adjustment module 13 also simultaneously reduces at least a portion of frequencies of the input voice, wherein the extent of reducing at least a portion of frequencies of the input voice when adjusting the sound output energy of the Nth step is greater than the extent of reducing at least a portion of frequencies of the input voice when adjusting the sound output energy of the N−1th step. For example, when the volume is adjusted to the third step, the voice output adjustment module 13 may transpose at least a portion of the frequency block of the input voice, so that the lowest frequency of the energy distribution block of the input voice is aligned to 5,100 Hz; when the volume is adjusted to the 4th step, the voice output adjustment module 13 aligns the lowest frequency portion of the energy distribution block of the input voice to 4,800 Hz. In this way, the voice processing module 12 and the voice output adjustment module 13 can jointly adjust the output voice.

Finally the method proceeds to step 204: outputting the output voice.

Finally the hearing aid 10 uses the voice player 14 to output the output voice for the hearing impaired or the elderly people.

It should be noted that the method for adjusting the output voice output voice of the hearing aid of the present invention is not limited to the above-described order of steps, and the order of the steps may be changed as long as the object of the present invention can be achieved.

From the description of the hearing aid 10 and the hearing aid output voice adjustment method, it can be seen that the hearing aid of the present invention can simultaneously adjust the volume and the frequency of the output voice. In this way, the hearing impaired or the elderly people can hear the voice clearly regardless of the output energy level.

It should be noted that the described embodiments are only for illustrative and exemplary purposes, and that various changes and modifications may be made to the described embodiments without departing from the scope of the invention as disposed by the appended claims.

What is claimed is:

1. A hearing aid output voice adjustment method for a hearing aid, wherein the hearing aid comprises a microphone, a voice processing module, a voice output adjustment module and a voice player, the method comprising:

receiving an input voice;

modifying an sound output energy of the input voice, wherein the sound output energy of the nth step is greater than that of the n−1th step, $2 \leq n \leq N$, $N \geq 3$;

simultaneously reducing at least a portion of frequencies of the input voice to form an output voice, and wherein an extent of reducing at least a portion of frequencies of the input voice when adjusting the sound output energy of the Nth step is greater than an extent of reducing at least a portion of frequencies of the input voice when adjusting the sound output energy of the N−1th step; and outputting the output voice.

2. The hearing aid output voice adjustment method for a hearing aid as claimed in claim 1 further comprising reducing at least a portion of frequencies of the input voice for m steps, wherein $n \geq m$.

3. The hearing aid output voice adjustment method for a hearing aid as claimed in claim 1, wherein the step of reducing the at least a portion of frequencies of the input voice comprises reducing high frequency consonants in the input voice.

4. The hearing aid output voice adjustment method for a hearing aid as claimed in claim 3, wherein vowel frequencies in the input voice will not be adjusted.

5. A hearing aid, comprising:

a microphone receiving an input voice;

a voice output adjustment module;

a voice player for outputting an output voice;

a voice processing module electrically coupled with the microphone, the voice output adjustment module, and the voice player, the voice processing module receiving the input voice and modifying a sound output energy of the input voice to form the output voice, wherein the voice processing module is used for adjusting sound output energies of at least N steps, wherein the sound output energy of the nth step is greater than that of the n−1th step, $2 \leq n \leq N$, $N \geq 3$;

wherein the hearing aid is characterized in that:

when the voice processing module adjusts the sound output energy of the Nth step, the voice output adjustment module also simultaneously reduces at least a portion of frequencies of the input voice, and wherein an extent of reducing at least a portion of frequencies of the input voice when adjusting the sound output energy of the Nth step is greater than an extent of reducing at least a portion of frequencies of the input voice when adjusting the sound output energy of the N−1th step.

6. The hearing aid as claimed in claim 5, wherein the voice output adjustment module reduces at least a portion of frequencies of the input voice for m steps, wherein $n \geq m$.

7. The hearing aid as claimed in claim 5, wherein the at least a portion of frequencies of the input voice reduced by the voice output adjustment module comprises adjusting high frequency consonants in the input voice.

8. The hearing aid as claimed in claim 7, wherein the voice output adjustment module does not adjust vowel frequencies in the input voice.

* * * * *